US006082161A

United States Patent [19]

Marushita et al.

[11] Patent Number: 6,082,161

[45] Date of Patent: Jul. 4, 2000

[54] METHOD AND APPARATUS OF STABLY CONTROLLING ROLLING MILL

[75] Inventors: Yoshihiro Marushita; Hidetoshi Ikeda; Kentaro Yano; Makoto Tsukiyama, all of Tokyo, Japan

[73] Assignee: Mitsubishi Denki Kabushiki Kaisha, Tokyo, Japan

[21] Appl. No.: 09/357,911

[22] Filed: Jul. 21, 1999

[30] Foreign Application Priority Data

Jul. 23, 1998 [JP] Japan ..... 10-208050

[51] Int. Cl.[7] ..... B21B 37/58

[52] U.S. Cl. ..... 72/10.4; 72/10.6; 72/13.3; 72/14.4

[58] Field of Search ..... 72/10.1, 10.4, 72/10.6, 10.7, 12.1, 13.3, 13.4, 14.4, 14.5

[56] References Cited

U.S. PATENT DOCUMENTS 4,521,859 6/1985 Fapiano ..... 72/10.4
4,570,472 2/1986 Kuwano ..... 72/10.1
4,700,312 10/1987 Kikuma et al. ..... 72/10.4

FOREIGN PATENT DOCUMENTS 3-114607 5/1991 Japan ..... 72/14.4
6-182417 7/1994 Japan ..... 72/10.4

*Primary Examiner*—Ed Tolan
*Attorney, Agent, or Firm*—Leydig, Voit & Mayer

[57] ABSTRACT

In a stabilization control of rolling, proportional differential control of snake motion of a to-be-rolled material caused during a rolling process, is achieved on the basis of a lateral deviation of loads which are detected by load sensors disposed on a rolling mill, an instruction value for lateral deviation leveling is calculated from the lateral deviation and given to a draft device, and a roll gap is adjusted on the basis of the instruction value to stabilize the snake motion of the to-be-rolled material. A stabilization low-pass filter having a pole time constant substantially equal to a zero-point time constant of operation frequency characteristics of the rolling mill is employed in the proportional control.

4 Claims, 12 Drawing Sheets

METHOD AND APPARATUS OF STABLY CONTROLLING ROLLING MILL

BACKGROUND OF THE INVENTION

The present invention relates to a method of stably controlling a snake motion phenomenon of a to-be-rolled material which occurs in a step of rolling a long sheet metal in a rolling mill, and also to a controlling apparatus for stabilizing behavior of the rolled material in the rolling mill.

FIG. 12 shows a rolling system of the prior art to which the invention is to be directed. In the figure, 1 denotes a to-be-rolled material, 2*a* and 2*b* denote work rolls, 3*a* and 3*b* denote back-up rolls, 4*a* and 4*b* denote pressure sensors, 5 denotes the geometric center of a rolling mill, 6 denotes the geometric center of the to-be-rolled material, 8*a* and 8*b* denote draft devices, 9*a* and 9*b* denote load signals, 10*a* and 10*b* denote leveling signals, and 11 denotes a control device.

During a rolling process, a snake motion phenomenon in which the to-be-rolled material abruptly moves in the width direction is caused by mechanical characteristics of the rolling mill, lateral asymmetry in shape of the to-be-rolled material, a difference between rolling speeds of the left and right sides, and the like. When such a snake motion once occurs, rolling rolls are damaged so that the accuracy of a product is lowered, or the to-be-rolled material collides against the rolling mill so that the rolling process is disabled, thereby lowering the productivity.

Conventionally, a snake motion is prevented from occurring by conducting a rolling process with a crown so that rolling edge portions of a to-be-rolled material are thinner than the center portion. However, there is a tendency to reduce the degree of a crown so as to comply with the increasing demand for the higher accuracy of the thickness. Therefore, a situation inevitably arises in which a snake motion easily occurs.

As a technique of controlling a snake motion, disclosed are methods such as that in which the control device 11 indirectly detects the amount of a snake motion by means of the load signals and a snake motion control is conducted on the basis of the detected value corresponding to the amount of the snake motion, and that in which a snake motion sensor disposed in the inlet side of a rolling mill directly detects a snake motion and a snake motion control is conducted on the basis of the detected amount of the snake motion. In both methods, a proportional control, a proportional differential control, or the like is applied. Japanese Patent Publication (Kokai) No. 8-323412 discloses a control system in which the amount of a snake motion and a differential value of the amount are handled as state variables and a state feedback control is conducted by using a state variable that is estimated by an observer.

In the method in which the load signals are detected, a technique in which a proportional differential control is applied seems to cause the whole control system to become unstable. When this technique is applied to an actual rolling mill, however, the draft device functions as a delay system. As a result, the whole of the system is prevented from becoming unstable. However, the time constant of the delay system depends on the draft device, and it is difficult to arbitrarily design the time constant as a design factor of the control system. Furthermore, there is a problem in that, depending on the value of the time constant, the time constant cannot be used in stabilization of the whole system.

The above phenomenon will be described in detail. Assuming that a snake motion phenomenon and characteristics of a rolling mill affecting the snake motion phenomenon are included in a controlled object, operation characteristics of the controlled object are represented by expression (1).

$$\ddot{y}_c=\{ay_c+b(d_s+\delta S)+h_1\delta H\}/s^2+y_{c0}$$

$$\delta P=cy_c-d(d_s+\delta S)+h_2\delta H \tag{1}$$

where yc means the amount of a snake motion, yc0 means the initial amount of the snake motion, δS means a lateral deviation of leveling, δH means a wedge amount (a difference in thickness between the left and right sides of the to-be-rolled material) on the inlet side, δP means a lateral deviation of loads, and a, b, c, d, h1, and h2 are constants depending on the rolling mill, rolling conditions, etc.

When expression (1) is indicated in the form of a transfer function from the input δS to the output δP, expression (2) below is obtained. FIG. 2 shows frequency characteristics of expression (2).

$$\delta P=\frac{-ds^2+bc+ad}{s^2-d}\delta S \tag{2}$$

In the controlled object, there exist an unstable pole and an unstable zero point. Therefore, the system is very unstable and hence it is difficult to control the system. Specifically, when the gain is lower than 0 [dB] in the low-frequency region, or when the gain is higher than 0 [dB] in the high-frequency region, the system becomes unstable.

In FIG. 3, (a) shows frequency characteristics of an open-loop transfer function in the case where a proportional differential control is applied to the controlled object. When the control device is configured by only a proportional differential control, the system can be stabilized in the low-frequency region by adequately setting the proportional gain as shown in (a) of FIG. 3. By contrast, in the high-frequency region, the gain is affected by the differential gain so as to be infinity and hence the whole system inevitably becomes unstable. In (b) and (c) of the frequency characteristic diagram of FIG. 3 in which a proportional differential control is applied and the draft device is approximated by a delay system (in FIG. 3, a first order delay system), the gain in the high-frequency region is not infinity but constant, because of the characteristics of the delay system.

In the case where the draft device quickly responds, however, the gain characteristics in the high-frequency region exceeds 0 [dB] as shown in (b) of FIG. 3, and hence the system is unstable. Even in the case where the draft device has an adequate time constant as shown in (c) of FIG. 3, sufficient robust stability cannot be considered. In the design of a control gain mentioned in documents distributed in Thirty-first joint lecture on plastic working, "Study on a snake motion control in hot strip rolling," a stable range of a control gain is described, but a clear design method is not described. Furthermore, also robust stability is not described.

SUMMARY OF THE INVENTION

The invention has been conducted in order to solve the above-discussed problems of the prior art. It is an object of the invention to provide a method of stably controlling a snake motion phenomenon without being affected by operation characteristics of a rolling mill, and an apparatus for the same.

According to a first configuration of the invention, in a method of stably controlling a rolling mill in which a proportional differential control is performed on a snake motion of a to-be-rolled material which is caused during a rolling process, on the basis of a lateral deviation of loads which are detected by load sensors disposed on a rolling mill, an instruction value of a lateral deviation of leveling which is to be given to a draft device is calculated, and a roll gap is adjusted on the basis of the instruction value to stabilize the snake motion of the to-be-rolled material, a stabilization low-pass filter is disposed, the stabilization low-pass filter having a pole time constant which is substantially equal to a zero-point time constant of operation frequency characteristics of the rolling mill.

According to a second configuration of the invention, in the method of stably controlling a rolling mill, frequency characteristics of a snake motion phenomenon including characteristics of the rolling mill which is a controlled object is analyzed, the pole time constant of the stabilization low-pass filter is determined on the basis of a zero point of the controlled object, the zero-point time constant of the proportional differential control is determined on the basis of a pole of the controlled object, and characteristics of a low-frequency region and those of a high-frequency region are set independently of each other.

According to a third configuration of the invention, in the method of stably controlling a rolling mill, stabilization control gain determining means for analyzing a system in which a snake motion phenomenon including characteristics of the rolling mill, and the control device having parameters set forth in claim 2 are combined with each other, and considering robust stability and steady-state deviation of the amount of a snake motion is disposed.

According to a fourth configuration of the invention, in an apparatus for stably controlling a rolling mill for rolling a long material to be rolled, the apparatus comprises: pressure sensors which measure depressing loads of right and left sides and generate pressure signals of right and left sides; and a control device which generates depressing instruction signals for the right and left sides on the basis of the pressure signals of the right and left sides, and the control device comprises: a time constant of a proportional differential control which is substantially equal to a pole time constant of operation frequency characteristics of a rolling mill; and a stabilization low-pass filter having a pole time constant which is substantially equal to a zero-point time constant of the rolling mill, thereby stably controlling a snake motion phenomenon of the to-be-rolled material.

DETAILED DESCRIPTION OF THE PREFERRED EMBODIMENTS

The provision of a stabilization low-pass filter in a control device configured with a proportional differential control enables stability of the whole system irrespective of the time constant of a draft device. When frequency characteristics of the controlled object and the control device are analyzed, control parameters including the time constant of a stabilization low-pass filter can be designed in consideration of robust stability. Hereinafter, a method of determining control parameters will be described with reference to an embodiment of the invention.

Figure 1:
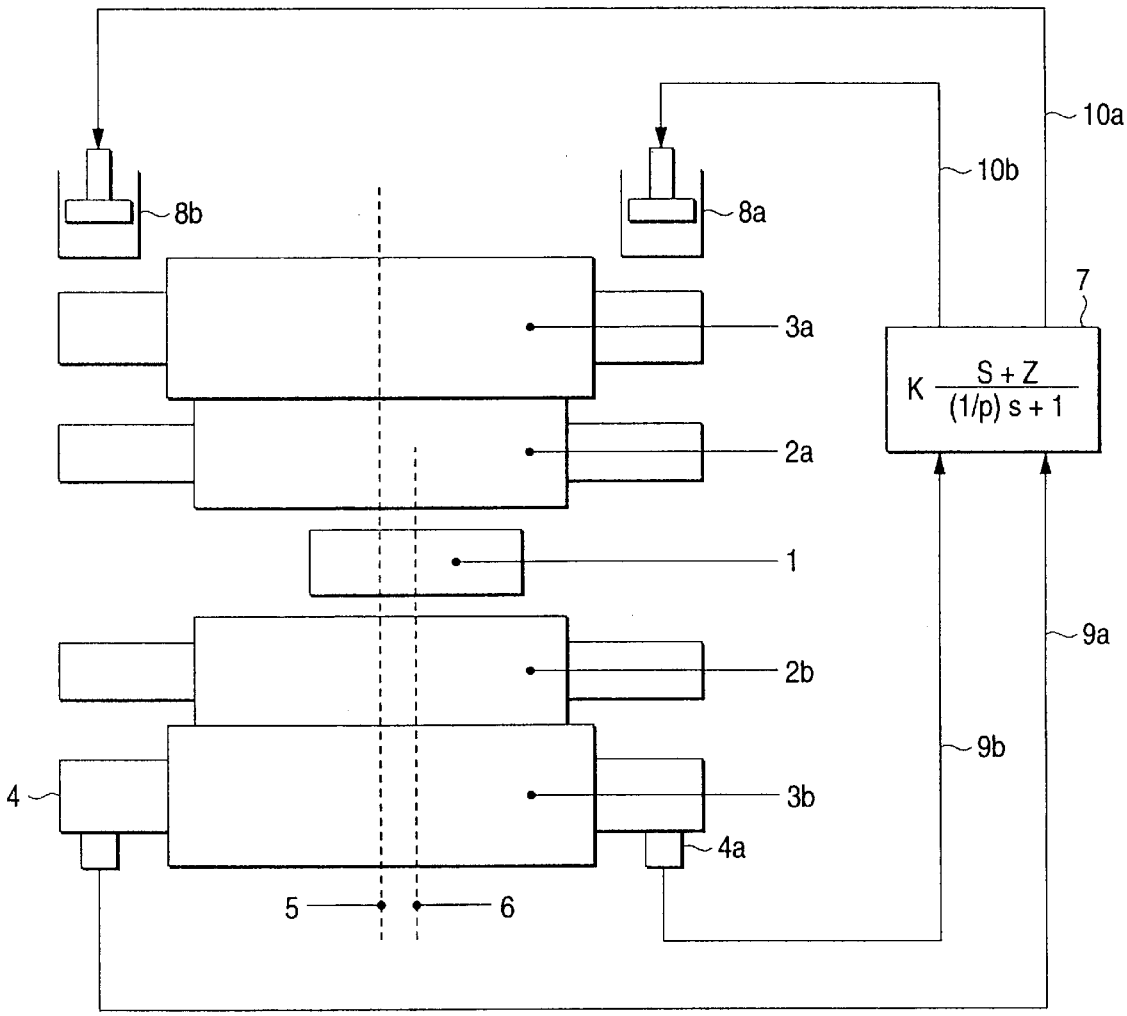
FIG. 1 is a diagram showing the configuration of a rolling system including a snake motion control system of the invention.

As described for the prior art, when a proportional differential control is applied to a differential loading system, the whole control system seems to become unstable, but a draft device constituting the control system is approximated by a delay system, with the result that the whole system is prevented from becoming unstable. When the technique disclosed in Japanese Patent Publication (Kokai) No. 8-323412 is analyzed by means of a frequency region, the technique can be similarly deemed as a combination of a proportional differential control and a delay system. FIG. 1 shows the configuration of a rolling system including a control device of the invention. In the figure, 7 denotes the control device of a control system of the invention. Hereinafter, a method of determining characteristics of the control system of the invention will be described.

The control device, which is a combination of the proportional differential control and the delay system, has a characteristic indicated by C (expression 3).

$$C = K\frac{s+z}{(s+p_1)(s+p_2)} \tag{3}$$

$$p_1 << p_2$$

Expression (3) is configured by a proportional differential control and a second order delay filter. Expression (3) contains four control parameters. When adjustment at the site is taken into account, a smaller number of control parameters is more advantageous. Therefore, it is assumed that p1<<p2, and p2 is neglected, whereby the number of control parameters is reduced. As a result, the control device is configured as a combination of a proportional differential control and a low-pass filter, such as indicated by expression (4). When a control device which can be actually realized is considered, p2 is a parameter which affects the stability in the high-frequency region in the control device indicated by expression (3), and has substantially no influence in a region where the control is actually conducted. Even if p2 is neglected, stability is not impaired. Therefore, this assumption can be regarded as appropriate.

$$C = K\frac{s+z}{s+p} \tag{4}$$

In expression (4), k/p is replaced with k so that the expression is rewritten as control device expression (5).

$$C = K\frac{S+Z}{(1/p)s+1} \tag{5}$$

When the device is indicated by expression (5), a change of p affects only characteristics in the low-frequency region, and that of z affects only characteristics in the high-frequency region. Consequently, the low- and high-frequency regions, i.e., p and z can be independently adjusted. The numerator of expression (5) indicates the proportional differential control, and the denominator indicates the stabilization low-pass filter.

Figure 2:
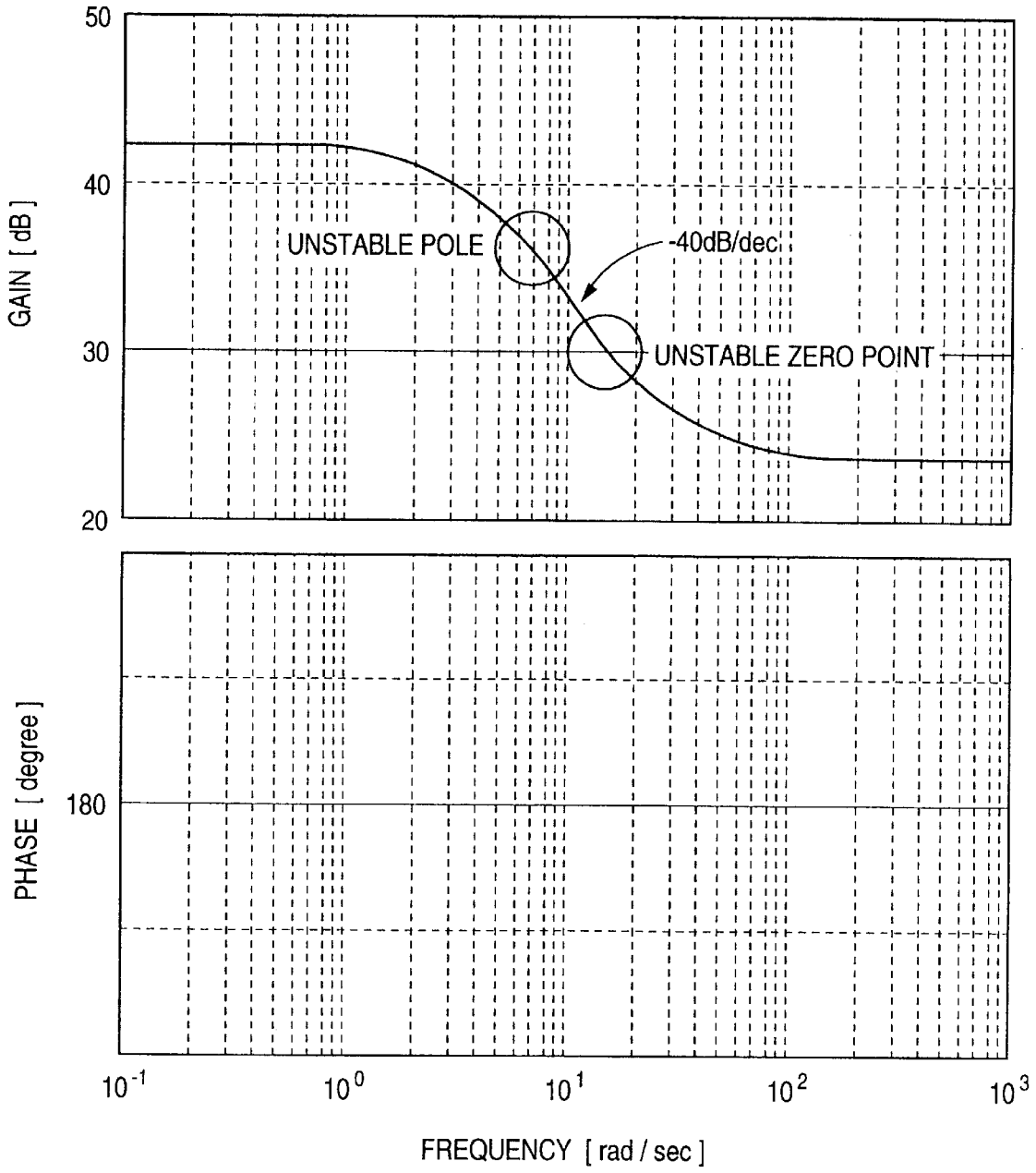
FIG. 2 is a diagram showing frequency characteristics of a snake motion phenomenon which is a controlled object, in the case where the input is a leveling deviation and the output is a load deviation.
Figure 3:
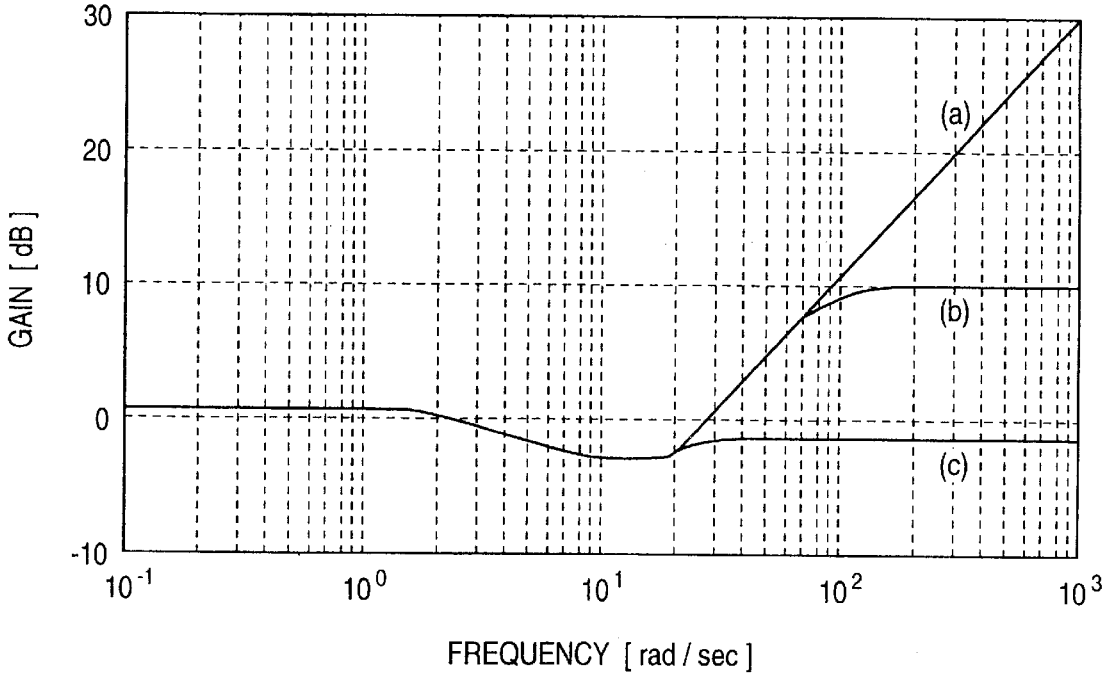
FIG. 3 is a diagram showing frequency characteristics of an open-loop transfer function in the case where a proportional differential control is applied.
Figure 4:
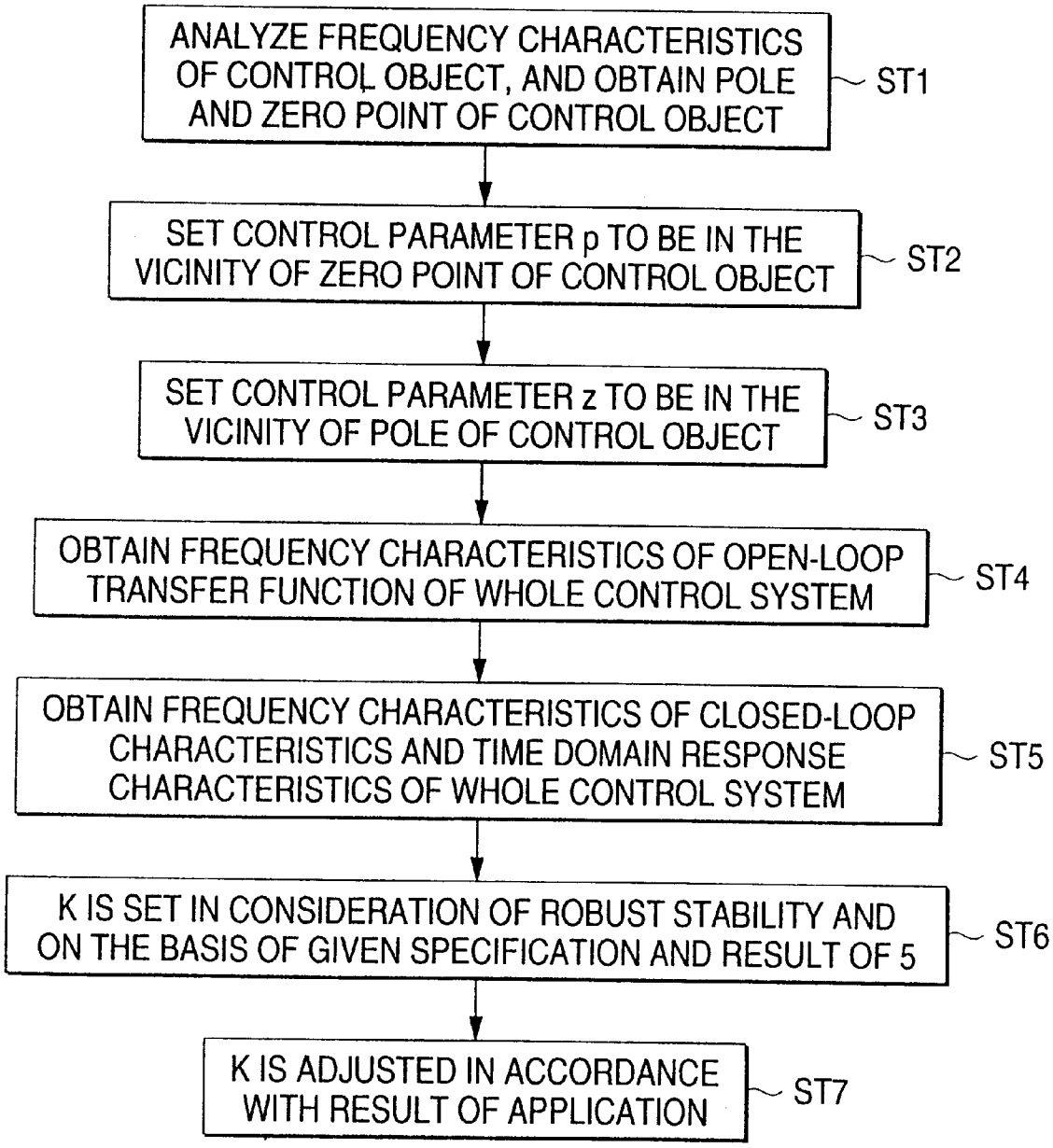
FIG. 4 is a diagram showing a flow of determination of control parameters.
Figure 5:
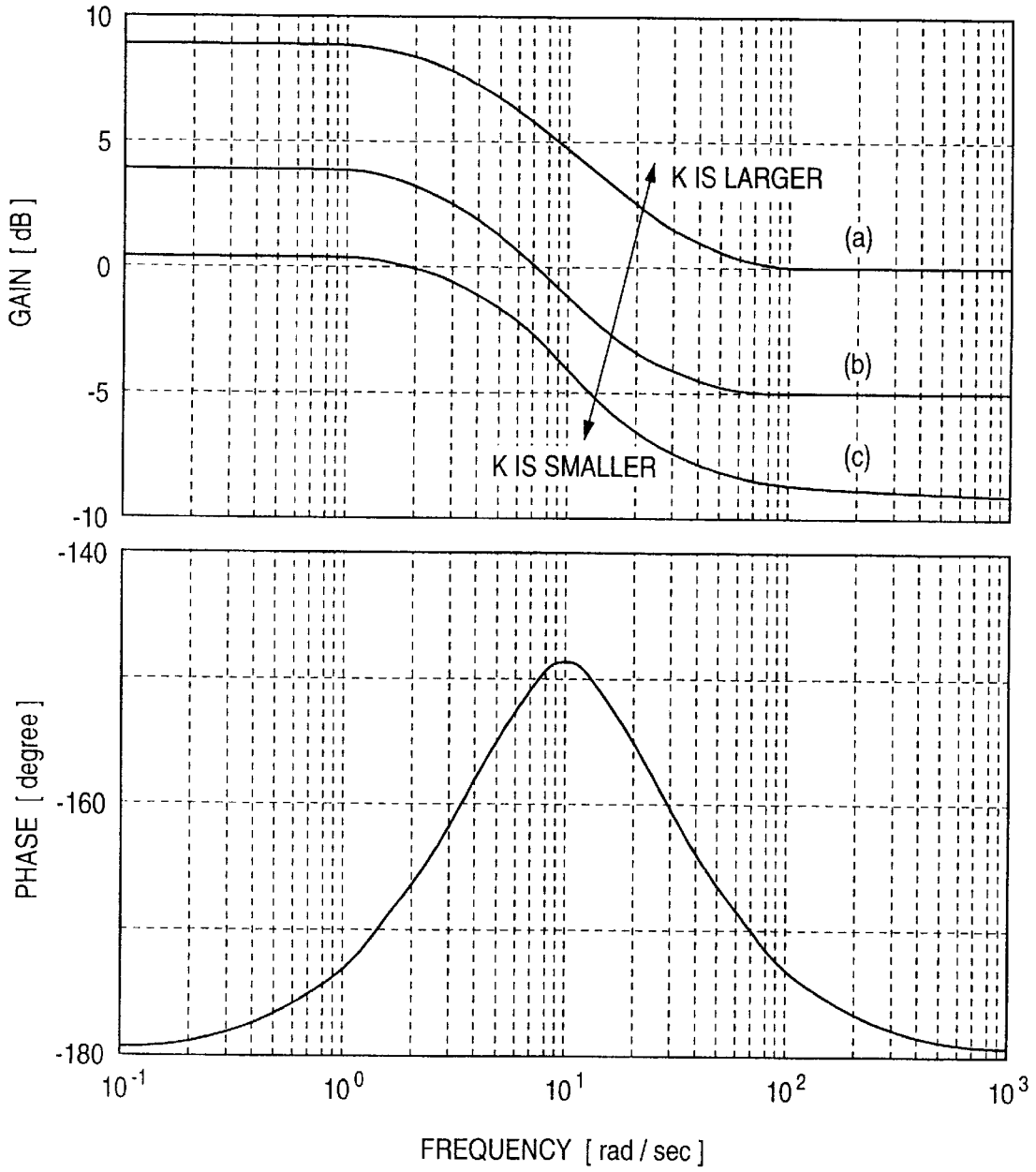
FIG. 5 is a diagram showing frequency characteristics of the open-loop transfer function in the case where a control parameter k is changed.
Figure 6:
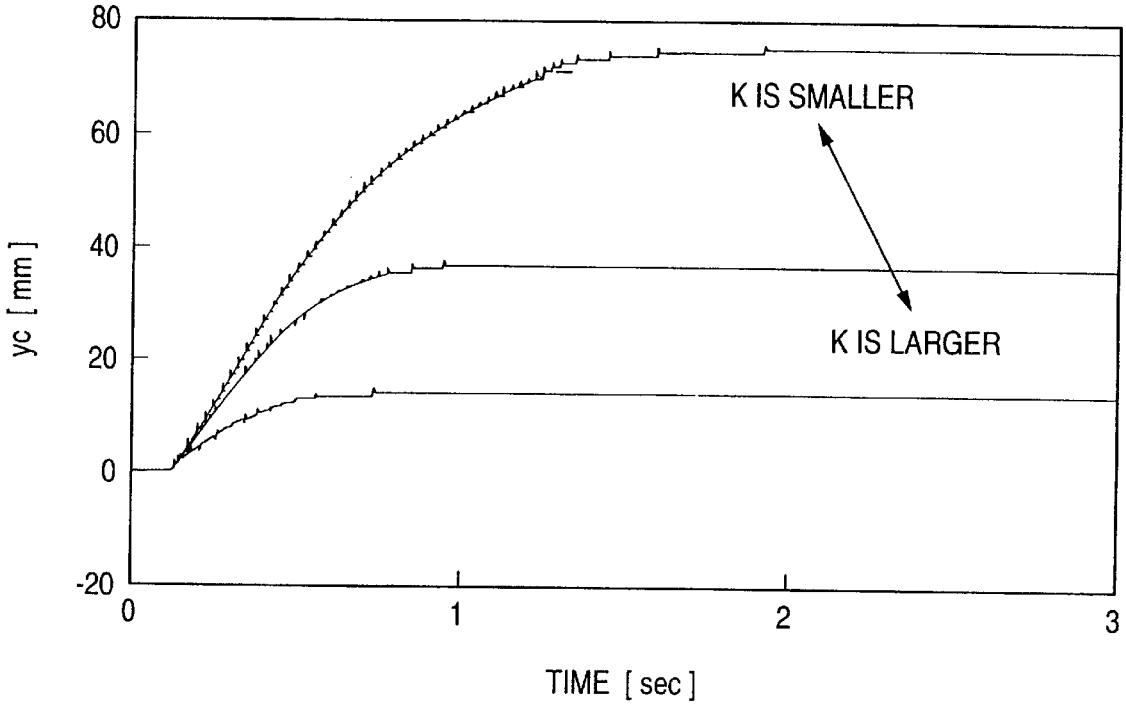
FIG. 6 is a diagram showing a step response of the amount of a snake motion in the case where the control parameter k is changed.

Hereinafter, influences of the control parameters on the control characteristics, and a method of determining the control parameters will be described. FIG. 4 shows a flow of the method of determining the control parameters. First, from the frequency characteristics or a mathematical model of a controlled object, such as shown in FIG. 2, a pole p0 and a zero point z0 of the controlled object are obtained. It is assumed that the control parameter p is set to a value in the vicinity of the zero point z0 of the controlled object and z is set to a value in the vicinity of the pole p0 of the controlled object. The control parameters p and z are not required to be strictly equal to z0 and p0, respectively, and are requested only to be coincident with them in a certain degree. For the sake of simplicity, the following description is done assuming that the control parameters are strictly coincident with the zero point and the pole, respectively. Influences in the case where k is varied under the above conditions will be described. In this case, the open-loop transfer function has frequency characteristics shown in FIG. 5. Assuming that a step disturbance ds is applied to the draft system in this case, the snake motion has time response shown in FIG. 6. As seen from FIG. 6, when the gain k is increased, the steady-state deviation of a snake motion is reduced. Therefore, the gain k may be determined in accordance with the specification of the allowable amount of a snake motion. From expressions (2) and (5) and with considering a closed-loop transfer function from the input δS and the amount of the snake motion yc, the relationship between the steady-state deviation and the steady-state deviation of the snake motion is represented by expression (6) based on the convergence value of the time domain response.

$$y(1 \to \infty) = \frac{b}{Kz(bc+ad)-a}d_s \tag{6}$$

From the steady-state deviation of the amount of the snake motion of expression (6), the range of the gain k can be obtained. As described above, however, the control system becomes unstable in both the cases where k is excessively large and where k is excessively small. Therefore, must be set to be within the range between (a) and (c) of FIG. 5. The range is shown by expression $$\frac{\sqrt{a}}{bc+ad} < K < \frac{1}{d\sqrt{bc+ad}} \tag{7}$$

When k is within the range of expression (7), stability can be ensured although the control characteristics may be good or bad. Furthermore, the expression means that robust stability is attained with respect to gain variation of the controlled object in this range.

Figure 7:
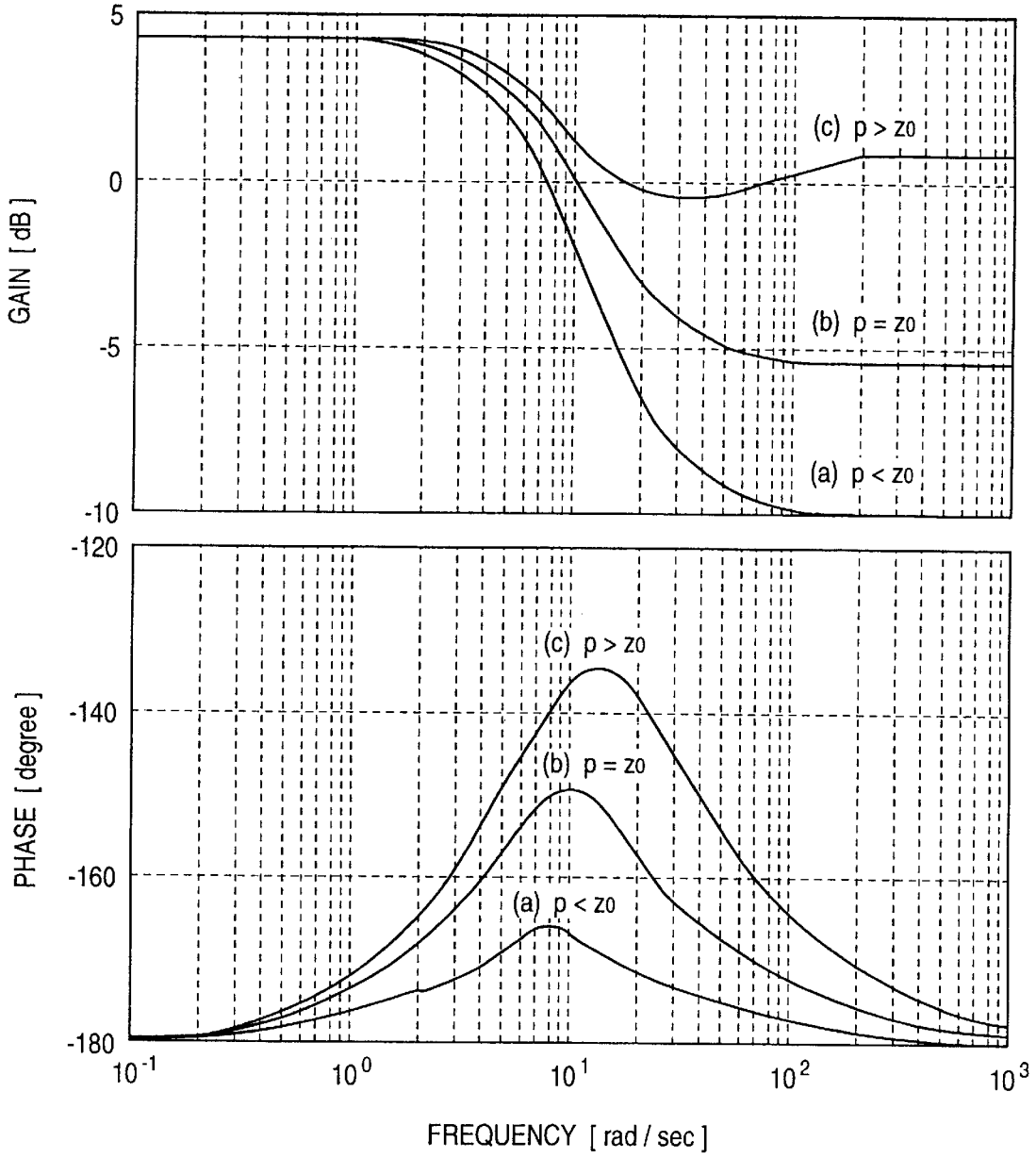
FIG. 7 is a diagram showing frequency characteristics of the open-loop transfer function in the case where a control parameter p is changed in the vicinity of a zero point z0 of the controlled object.
Figure 8:
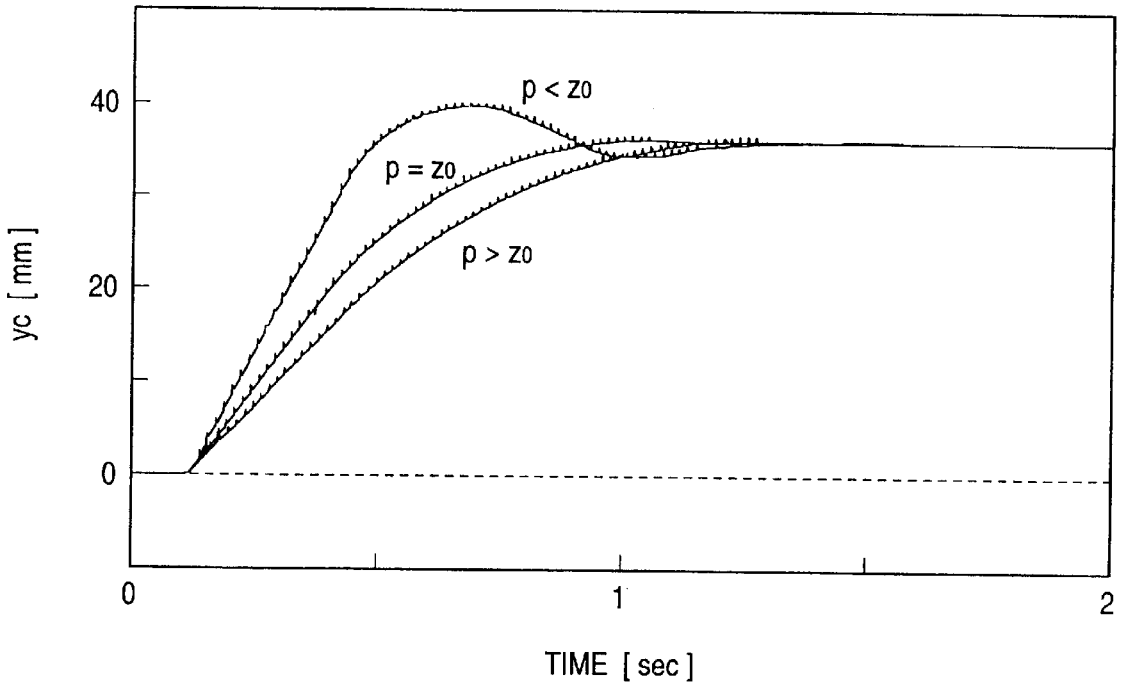
FIG. 8 is a diagram showing a step response of the amount of a snake motion in the case where the control parameter p is changed.

Next, influences of the control characteristics due to a change of p will be described, assuming that z is made equal to the pole p0 of the control object and k is set to an adequate value so as to be within the above-mentioned range. FIG. 7 shows a change of frequency characteristics of the open-loop transfer function in the case where p is changed, and FIG. 8 shows the step response of the amount of the snake motion in this case. When p is set to be smaller than the zero point z0 of the control object, the open-loop gain in the high-frequency region is lowered as shown in FIG. 7, and hence the lower limit of the range indicated by expression (7) is lowered. Therefore, robust stability is improved.

As seen from FIG. 8, however, the step response becomes oscillatory. By contrast, when p is set to be larger, robust stability in the high-frequency region is impaired. From the above, it seems that p is preferably set to be in the vicinity of the zero point z0 of the controlled object.

Figure 9:
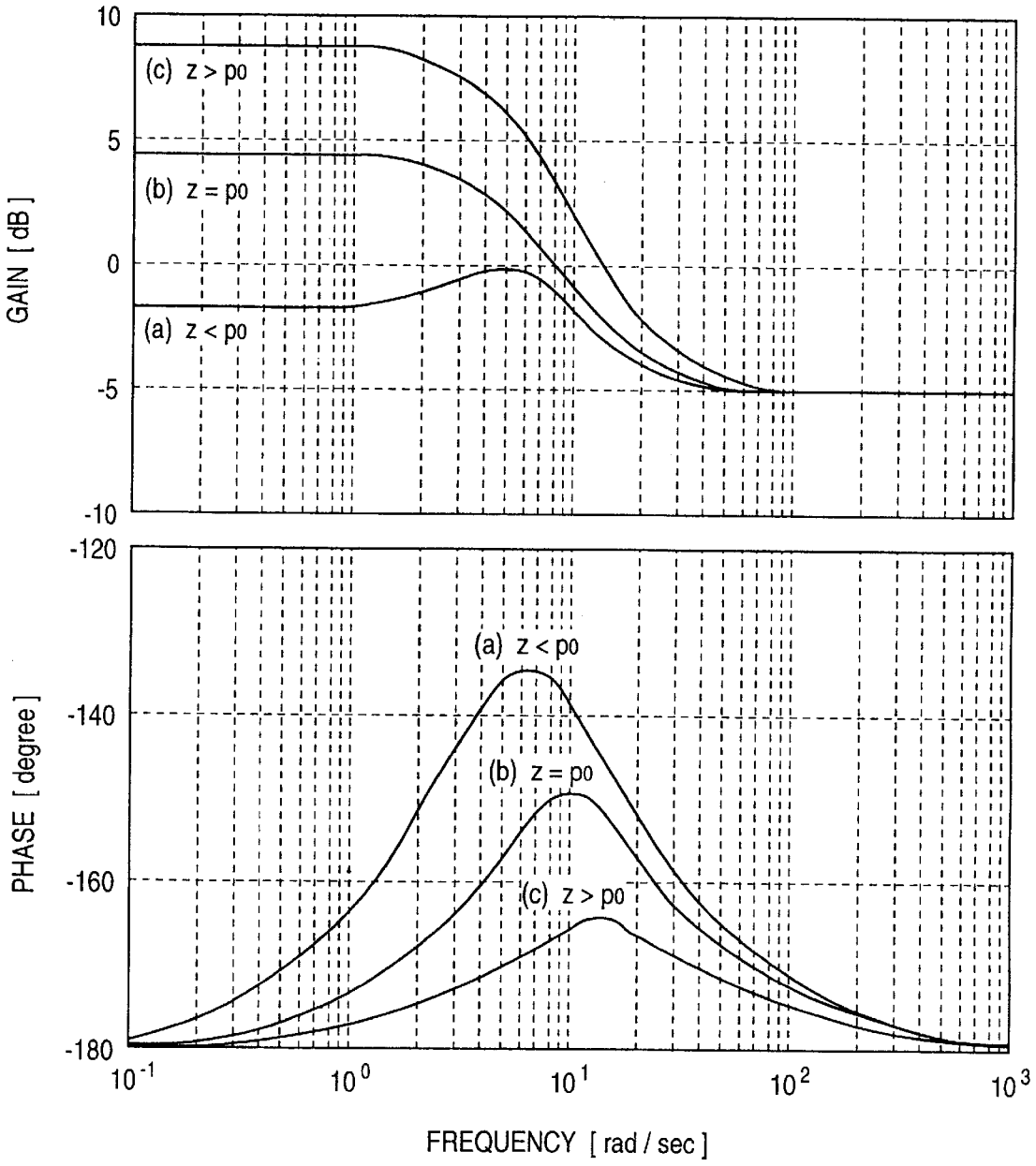
FIG. 9 is a diagram showing frequency characteristics of the open-loop transfer function in the case where a control parameter z is changed in the vicinity of a pole p0 of the controlled object.
Figure 10:
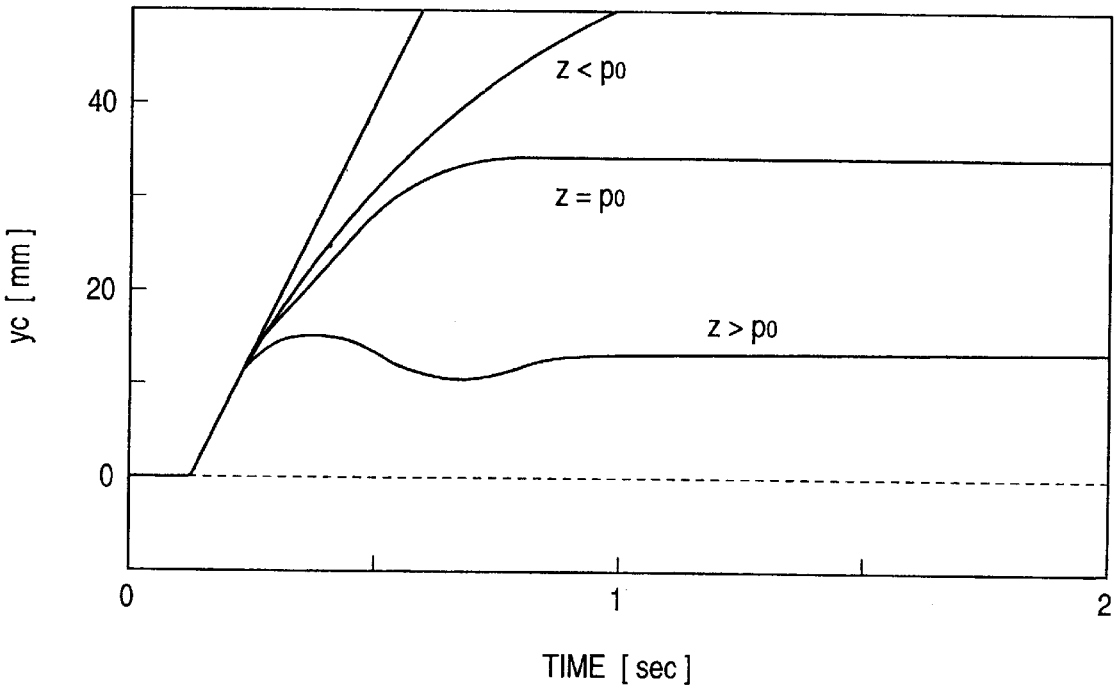
FIG. 10 is a diagram showing a step response of the amount of a snake motion in the case where the control parameter z is changed.
Figure 11A:
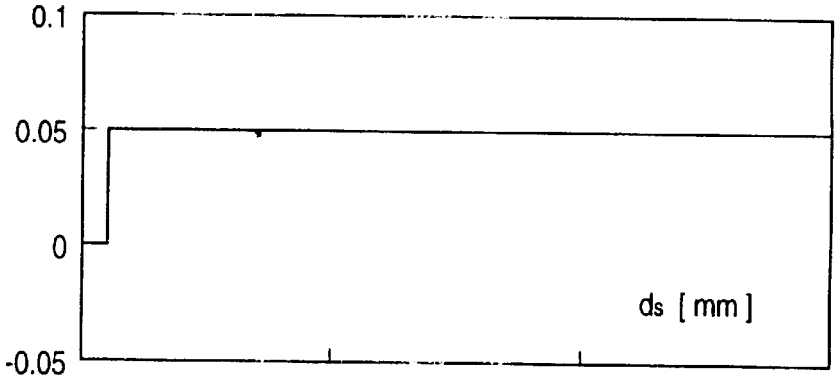
FIGS. 11*a–d* are diagrams showing a change of the amount of a snake motion with respect to a step disturbance in an embodiment.
Figure 11B:
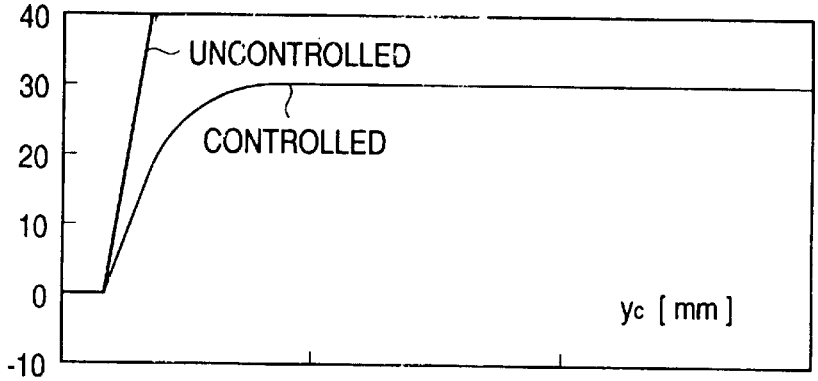
Figure 11C:
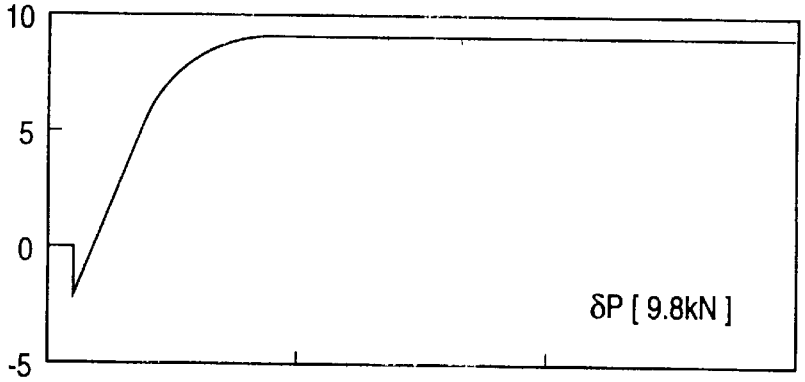
Figure 11D:
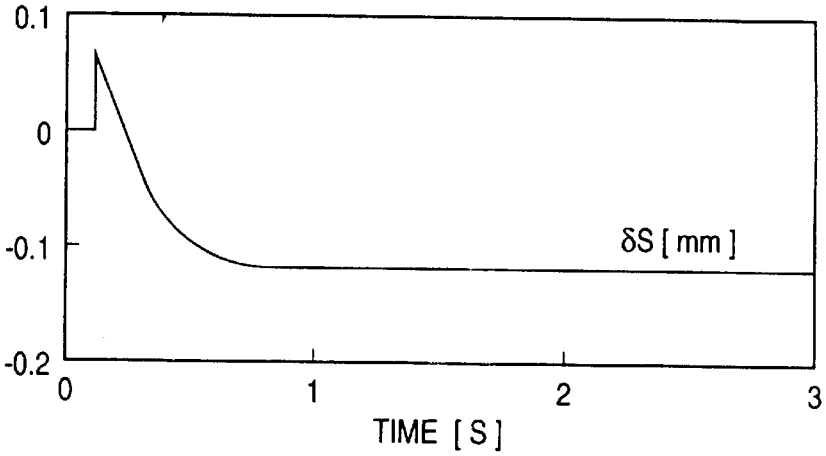
Figure 12:
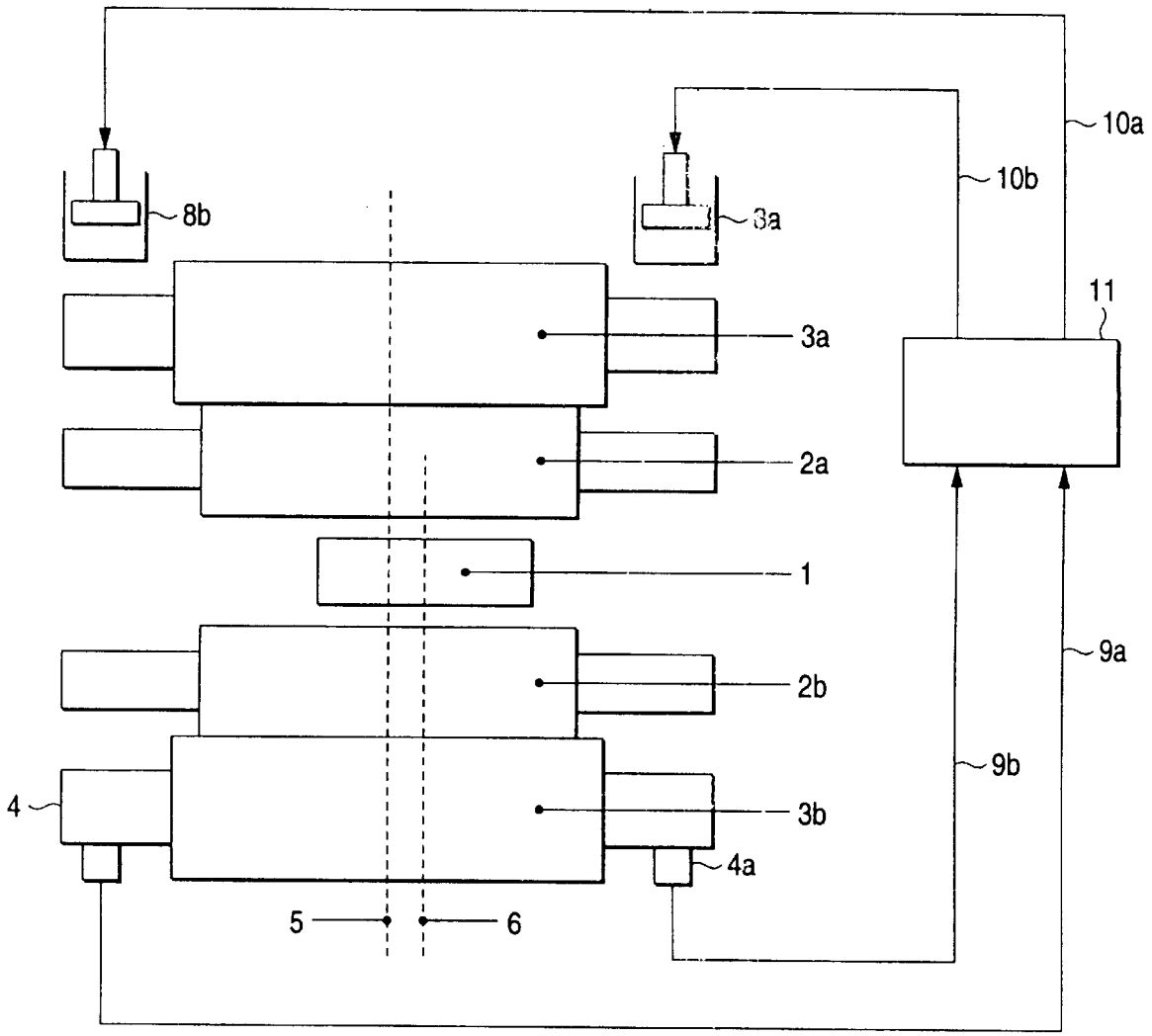
FIG. 12 Prior Art
FIG. 12 is a diagram showing the configuration of a rolling system including a control device of the prior art.

When z is changed while p is made equal to the zero point z0 of the controlled object and k is set to an adequate value so as to be within the range of expression (7) as a result of the above, the frequency characteristics and the amount of the snake motion have step responses shown in FIGS. 9 and 10. From this, when z is larger than the pole p0 of the controlled object, robust stability is improved as shown in FIG. 9. Furthermore, the gain in the low-frequency region is increased, and hence the steady-state deviation of the amount of the snake motion can be reduced as shown in FIG. 10. However, the response is oscillatory. By contrast, when z is made smaller than p0, robust stability is impaired. From the above, it seems that z is preferably set to be in the vicinity of the pole p0 of the controlled object.

FIG. 4 shows a rational method of determining parameters of the control system which is derived from the result of the above study. In ST1, the frequency characteristics of the operation of a rolling mill, which is a controlled object, is analyzed and the pole frequency p0 and the zero-point frequency z0 in the frequency characteristics are obtained. In ST2, the pole frequency p of the low-pass filter of the control system is set to be in the vicinity of the zero-point frequency z0 of the controlled object. As a result, conditions for a stable snake motion control can be ensured without being affected by the time constant of the rolling mill.

In ST3, the proportional differential time constant z of the control system is set to be in the vicinity of the pole frequency p0 of the controlled object. As a result, the proportional differential time constant of the control device, and the pole time constant of the stabilization low-pas filter can be optimally combined with each other so as to be suitable to the operation characteristics of the rolling mill.

In ST4, the frequency characteristics of the open-loop transfer function of the whole control system are obtained. In ST5, the frequency characteristics of the closed-loop characteristics and the time domain response characteristics of the whole control system are obtained. In ST6, the gain coefficient k is changed, and the time domain response characteristics are checked in both the view points of the specification of the allowable limit amount of the snake motion and robust stability. The optimum gain coefficient k is determined in ST7. As a result, while satisfying requests for the quality of a rolled product, it is possible to stably cope with a change of characteristics of the rolling mill or the to-be-rolled material, and both the quality of a product and the utilization rate of the rolling step can be enhanced.

FIG. 11 shows results of a simulation of the snake motion control which was executed by the control device configured in accordance with the flow shown in FIG. 4. In the simulation, a step disturbance such as shown in FIG. 11(*a*), which is to be applied to the draft system, was used as a disturbance. As seen from FIG. 11(*b*), the amount of a snake motion is rapidly stabilized.

In the above, the control system of the invention has been described with reference to the example of the stabilization control of a snake motion. The invention can be applied also to another controlled object as far as the characteristics of the controlled object are indicated in the form of expression (2).

In the above description, the words "pole time constant" or "zero-point time constant" are used. It should be noted that the "time constant" and the "frequency" are in a certain relationship. That is, the "time constant" is the reciprocal of "frequency".

According to the first configuration of the invention, in a method of stably controlling a rolling mill in proportional differential control of snake motion of a to-be-rolled material caused during a rolling process, on the basis of a lateral deviation of loads which are detected by load sensors disposed on a rolling mill, an instruction value of a lateral deviation of leveling which is to be given to a draft device is calculated, and a roll gap is adjusted on the basis of the instruction value to stabilize the snake motion of the to-be-rolled material. A stabilization low-pass filter having a pole time constant which is substantially equal to a zero-point time constant of operation frequency characteristics of the rolling mill is included. Therefore, conditions of a stable snake motion control can be ensured without being affected by the time constant of the rolling mill.

According to the second configuration of the invention, in the method of stably controlling a rolling mill, frequency characteristics of a snake motion phenomenon including characteristics of the rolling mill, which is a controlled object, is analyzed, the pole time constant of a stabilization low-pass filter is determined on the basis of a zero point of the controlled object, the zero-point time constant of the proportional differential control is determined on the basis of a pole of the controlled object, and characteristics of a low-frequency region and those of a high-frequency region are set independently of each other. Therefore, the proportional differential time constant of the control device, and the pole time constant of the stabilization low-pas filter can be optimally combined with each other so as to be suitable to the operation characteristics of the rolling mill.

According to the third configuration of the invention, in the method of stably controlling a rolling mill, a gain coefficient is determined in consideration of both the amount of the snake motion of the to-be-rolled material and robust stability. Therefore, while satisfying requests for the quality of a rolled product, it is possible to stably cope with a change of characteristics of the rolling mill or the to-be-rolled material, and both the quality of a product and the utilization rate of the rolling step can be enhanced.

According to the fourth configuration of the invention, in an apparatus for stably controlling a rolling mill for rolling a long material to be rolled, the apparatus comprises: pressure sensors which measure depressing loads of right and left sides and generate pressure signals of right and left sides; and a control device which generates depressing instruction signals for the right and left sides on the basis of the pressure signals of the right and left sides, wherein the control device comprises: a proportional differential control having a time constant which is substantially equal to a pole time constant of operation frequency characteristics of a rolling mill; and a stabilization low-pass filter having a pole time constant which is substantially equal to a zero-point time constant of the rolling mill, thereby stably controlling a snake motion phenomenon of the to-be-rolled material. Therefore, the proportional differential time constant of the control device, and the pole time constant of the stabilization low-pas filter can be optimally combined with each other so as to be suitable to the operation characteristics of the rolling mill.

What is claimed is:

1. A method of stably controlling a rolling mill, comprising:

detecting lateral deviation of loads on a to-be-rolled material during a rolling process with load sensors disposed on a rolling mill;

calculating an instruction value for lateral deviation leveling which is to be given to a pressure device on the basis of the detected lateral deviation of the loads, using a proportional differential control; and adjusting a roll gap of the rolling mill on the basis of the instruction value to stabilize snake motion of the to-be-rolled material, wherein the proportional differential control includes a stabilization low-pass filter having a pole time constant substantially equal to a zero-point time constant of operation frequency characteristics of the rolling mill.

2. The method of stably controlling a rolling mill according to claim 1, comprising:

analyzing frequency characteristics of a snake motion phenomenon including characteristics of the rolling mill which is a controlled object;

determining the pole time constant of said stabilization low-pass filter on the basis of a zero point of the controlled object;

determining the zero-point time constant of the proportional differential control on the basis of a pole of the controlled object; and setting characteristics of a low-frequency region and those of a high-frequency region independently of each other.

3. The method of stably controlling a rolling mill according to claim 2, further comprising determining a gain coefficient in consideration of both the snake motion of the to-be-rolled material and robust stability.

4. An apparatus for stably controlling a rolling mill for rolling a long material, comprising:

pressure sensors which measure depressing loads of right and left sides of a rolling mill and generate pressure signals of right and left sides of the rolling mill;

a control device which generates depressing instruction signals for the right and left sides of the rolling mill from the pressure signals of the right and left sides of the rolling mill and comprising a proportional differential control having a time constant substantially equal to a pole time constant of operation frequency characteristics of the rolling mill; and a stabilization low-pass filter having a pole time constant substantially equal to a zero-point time constant of the rolling mill, thereby stably controlling snake motion of material to-be-rolled in the rolling mill.

* * * * *